US011110314B1

(12) United States Patent
Wineman

(10) Patent No.: US 11,110,314 B1
(45) Date of Patent: Sep. 7, 2021

(54) EXERCISE BAR

(71) Applicant: Pvolve, LLC, New York, NY (US)

(72) Inventor: Stephanie Wineman, Birmingham, MI (US)

(73) Assignee: Pvolve, LLC, New York, NY (US)

( * ) Notice: Subject to any disclaimer, the term of this patent is extended or adjusted under 35 U.S.C. 154(b) by 0 days.

(21) Appl. No.: 17/248,134

(22) Filed: Jan. 11, 2021

(51) Int. Cl.

| | |
|---|---|
| ***A63B 21/072*** | (2006.01) |
| ***A63B 21/06*** | (2006.01) |
| ***A63B 21/00*** | (2006.01) |
| *A63B 71/00* | (2006.01) |

(52) U.S. Cl.
CPC ..... *A63B 21/0728* (2013.01); *A63B 21/0604* (2013.01); *A63B 21/4035* (2015.10); *A63B 2071/0072* (2013.01)

(58) Field of Classification Search
None
See application file for complete search history.

(56) References Cited

U.S. PATENT DOCUMENTS

| | | | | |
|---|---|---|---|---|
| 3,116,926 A | | 1/1964 | Owen et al. | |
| 4,440,391 A | | 4/1984 | Saenz et al. | |
| 4,518,162 A | | 5/1985 | Oates | |
| 4,775,149 A | | 10/1988 | Wilson | |
| 5,407,413 A | | 4/1995 | Kupferman | |
| 5,465,967 A | * | 11/1995 | Boeckenhaupt | A63B 60/24 473/297 |
| 5,653,664 A | * | 8/1997 | Jennings | A63B 15/00 473/256 |
| 6,379,286 B1 | * | 4/2002 | Scopino | A63B 15/00 482/93 |
| 6,402,668 B1 | | 6/2002 | Harker | |
| 6,599,222 B2 | * | 7/2003 | Wince | A63B 21/0724 482/106 |
| 7,044,858 B1 | * | 5/2006 | Otto | F41B 15/022 463/47.2 |
| 7,841,972 B1 | * | 11/2010 | Huang | A63B 21/00196 482/108 |
| 8,888,665 B2 | * | 11/2014 | Pfitzer | A63B 21/0724 482/104 |
| 9,126,075 B2 | * | 9/2015 | Tomaszewski | A63B 21/06 |
| 9,283,453 B1 | * | 3/2016 | Johnson | A63B 53/10 |
| 9,320,933 B2 | * | 4/2016 | Kessler | A63B 21/0608 |

(Continued)

OTHER PUBLICATIONS

"Exercise Bar—Bionic Body BBEB-20", Webpage, Last Accessed Jan. 7, 2021, https://bionicbodygear.com/exercise-bar-bionic-body-bbeb-20/, 6 pages.

(Continued)

*Primary Examiner* — Joshua Lee
(74) *Attorney, Agent, or Firm* — Foley & Lardner LLP

(57) ABSTRACT

An exercise device includes a first exercise bar. The first exercise bar includes a first tube extending from a first end to a second end and defining a cavity, a first weight configured to be selectively received within the first cavity, and a first slow loading mechanism coupled to the first tube proximate the second end and configured to contact the first weight when the first weight is received by the first cavity to provide a friction force to the first weight to slow the loading of the first weight into the first cavity.

20 Claims, 13 Drawing Sheets

(56) References Cited

U.S. PATENT DOCUMENTS

| | | | | |
|---|---|---|---|---|
| 2002/0107095 | A1* | 8/2002 | Becker | A63B 53/00 473/564 |
| 2004/0063554 | A1* | 4/2004 | Wince | A63B 21/0724 482/108 |
| 2009/0093349 | A1 | 4/2009 | Cooper | |
| 2012/0302409 | A1* | 11/2012 | Mikulski | A63B 21/0724 482/93 |
| 2013/0252789 | A1 | 9/2013 | Hess | |

OTHER PUBLICATIONS

"Probar Mobility—The Premium Bar-Based Mobillity System", Webpage, Last Accessed Jan. 7, 2021, https://probarmobility.com/product/probar/, 3 pages.

"Workout Bar", Webpage, Last Accessed Jan. 11, 2021, https://bodybossportablegym.com/products/collapsable-workout-bar, 2 pages.

* cited by examiner

EXERCISE BAR

BACKGROUND

The present disclosure relates generally to exercise equipment. More specifically, the present disclosure relates to a weighted exercise bar that can be used for a variety of exercises, including lower body exercises (e.g., squats, lunges, deadlifts, calf raises, etc.), upper body exercises (e.g., shoulder press, bicep curls, bent-over rows, chest presses, etc.), and balance exercises (e.g., lateral lunges, one leg shoulder presses, single leg deadlifts, etc.), among others.

A user intending to engage in training one or more muscle groups using multiple exercises and ranges of motion oftentimes needs to use multiple different pieces of exercise equipment. In some instances, a user may implement a training technique intended to minimize rest time between exercises, which presents a challenge when multiple pieces of exercise equipment are required and may require set-up or other assistance prior to use, thus interrupting such a training technique. Furthermore, a user may purchase a specific piece of exercise equipment and soon outgrow the equipment due to needing a different amount of weight than the equipment is capable of supporting.

SUMMARY

One embodiment relates to an exercise device including a first exercise bar. The first exercise bar includes a first tube extending from a first end to a second end and defining a first cavity, a first weight configured to be selectively received within the first cavity, and a first slow loading mechanism coupled to the first tube proximate the second end. The first slow loading mechanism is configured to contact the first weight when the first weight is received by the first cavity to provide a friction force to the first weight to slow the loading of the first weight into the first cavity.

Another embodiment relates to an exercise bar including a first tube and a second tube. The first tube extends from a first end to a second end and defines a first cavity. The second tube extends from a third end to a fourth end and defines a second cavity. The second tube is configured to selectively couple to the first tube proximate the first and third ends. The exercise bar further includes a first weight configured to be selectively received within the first cavity, a second weight configured to be selectively received within the second cavity, a first slow loading mechanism coupled to the first tube and configured to slow the loading of the first weight into the first cavity, a second slow loading mechanism coupled to the second tube and configured to slow the loading of the second weight into the second cavity, a first end cap selectively coupled to the first weight and the first tube, and a second end cap selectively coupled to the second weight and the second tube.

Another embodiment relates to an exercise device comprising a first exercise bar. The first exercise bar includes a first tube extending from a first end to a second end and defining a first cavity, a first weight configured to be selectively received within the first cavity, and a first slow loading mechanism coupled to the first tube proximate the second end and configured to slow the loading of the first weight into the first cavity.

This summary is illustrative only and should not be regarded as limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, an exercise bar device is shown according to one embodiment. The exercise bar device can be an adjustably weighted exercise bar by being loaded with weights having a variety of weight (e.g., the weights may weigh 2 pounds, 5 pounds, 10 pounds, 20 pounds, and so on and any size in between). The exercise bar device can be used by a user to exercise any part of their body, including both their upper body and their lower body. The exercise bar device includes a first exercise bar and a second exercise bar that can be selectively coupled together to form the exercise bar device. Each of the exercise bars further includes a tube having a cavity located therein, a grip surface covering the tube, a male or female central coupling coupled to the tube, a slow loading mechanism, at least one hybrid end cap, one or more weights, and, in some embodiments, a female end cap. The exercise bar device can be used in different configurations, including as a single long bar (e.g., the first exercise bar is selectively coupled to the second exercise bar to form the exercise bar device), as two separate bars (e.g., the first exercise bar is uncoupled from the second exercise bar), or as a single short bar (e.g., the first exercise bar is uncoupled from the second exercise bar and only one of the first exercise bar or the second exercise bar is used).

As mentioned above, each of the first exercise bar and the second exercise bar includes a tube. The tube further includes a hollow cavity located therein in which the weights can be received to adjust the weight of each exercise bar. In some embodiments, one or more weights can be selectively coupled to one another to combine the weights. In this way, each of the cavities can receive multiple weights. Similarly, the weights can be selectively coupled to the hybrid end caps to then be selectively coupled to the first exercise bar or the second exercise bar. In use, the exercise bar device is highly configurable in both structure and weight. As a result, the exercise bar device provides a multi-use exercise device that can be used to perform a large number of exercises.

Figure 1:
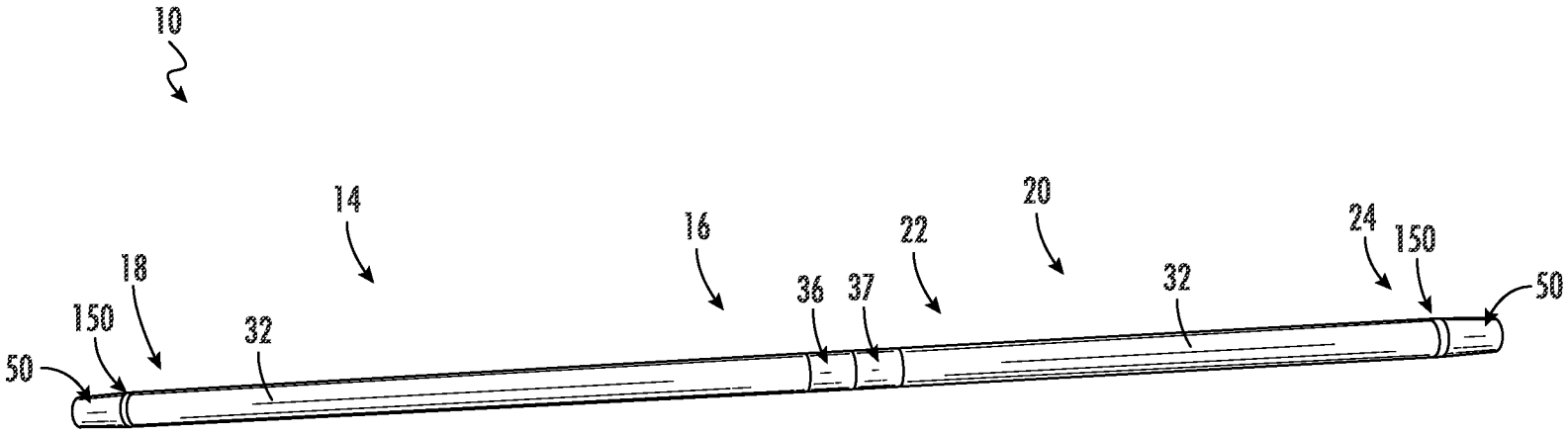
FIG. 1 is a perspective view of an exercise bar device in a first configuration, according to one embodiment.
Figure 2:
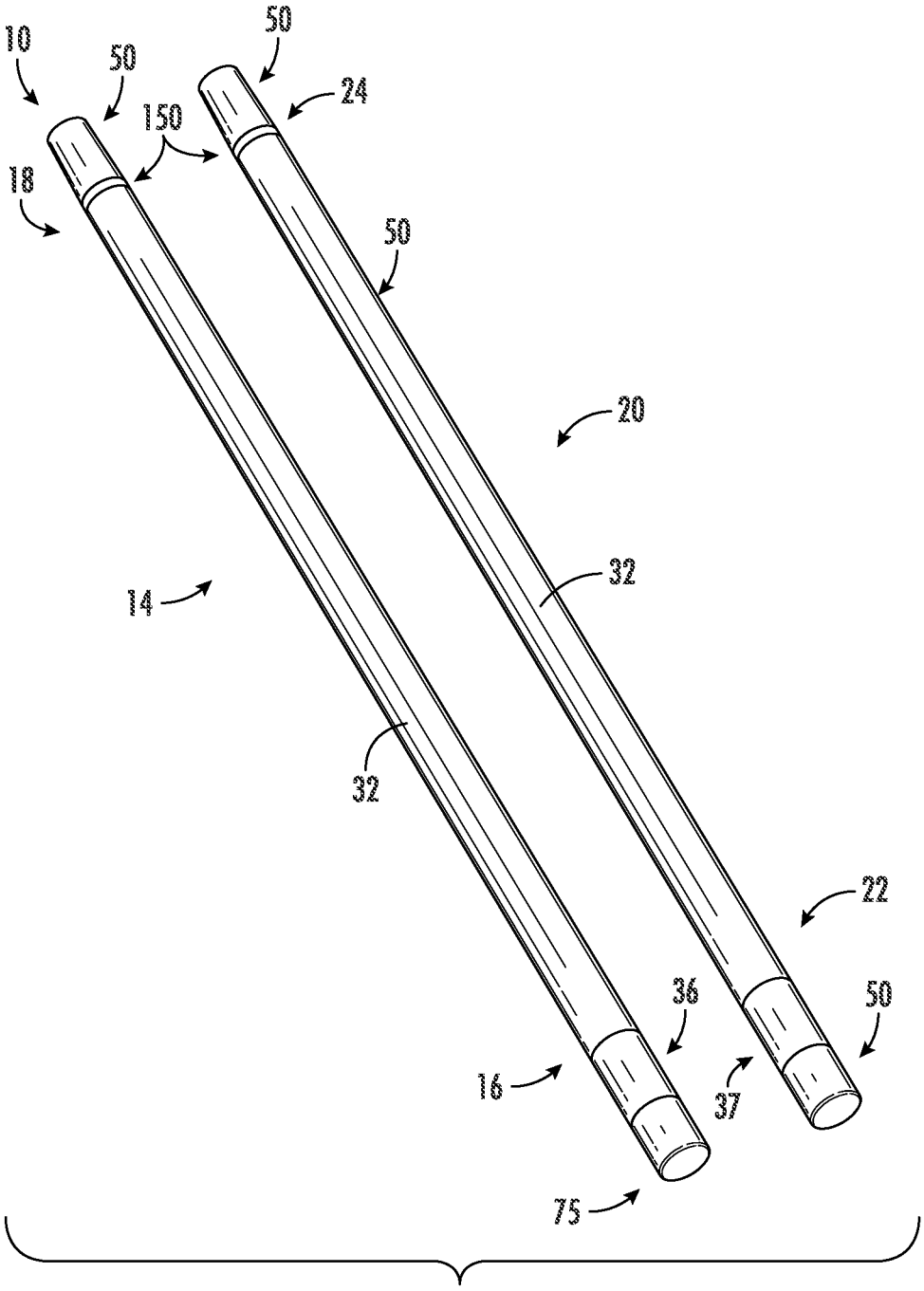
FIG. 2 is a perspective view of the exercise bar device of FIG. 1 in a second configuration.
Figure 3:
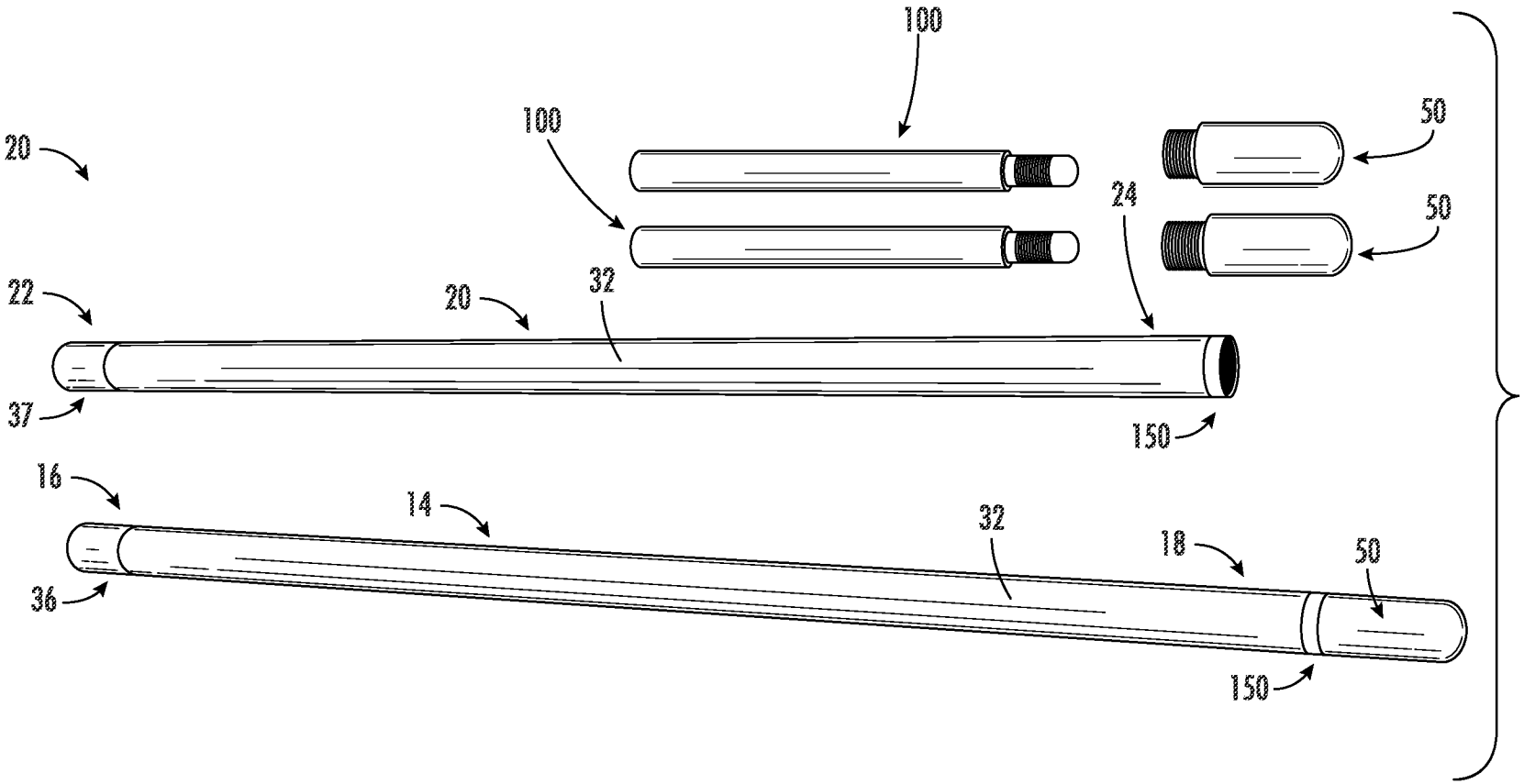
FIG. 3 is a partially exploded view of the exercise bar device of FIG. 1.
Figure 4:
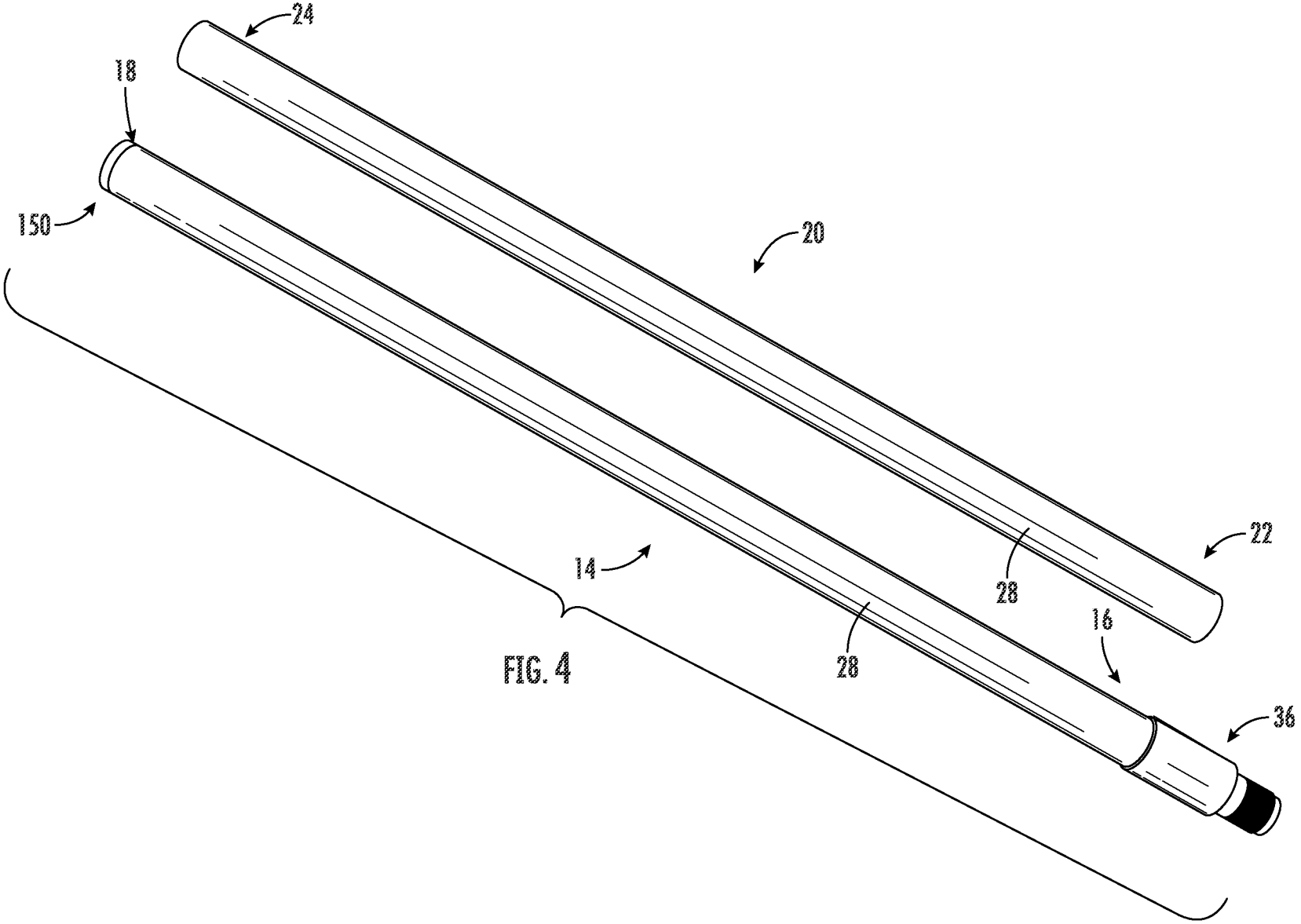
FIG. 4 is a perspective view of the exercise bar device of FIG. 1 with a grip surface and multiple endcaps removed.

Referring now to FIGS. 1-4, various views of the exercise bar device 10 are shown, according to one embodiment. The exercise bar device 10 is shown to include a first exercise bar 14 and a second exercise bar 20. The first exercise bar 14 and the second exercise bar 20 may be substantially the same (e.g., include similar components, same length, same cross-sectional diameter, same weight, etc.) and therefore similar reference numbers may be used for each bar. For example, the first exercise bar 14 and the second exercise bar 20 both include a tube 28 (which may be the same length, same inner diameter, same outer diameter, made of the same material, etc.). In operation, the first exercise bar 14 and the second exercise bar 20 may be selectively coupled via respective male and female central couplings 36, 37 to form the exercise bar device 10. When not selectively coupled to form the exercise bar device 10, each of the first exercise bar 14 and the second exercise bar 20 can be configured (as shown in FIG. 2) to form separate exercise devices that may be used individually or in combination with one another. In this way, the exercise bar device 10 can be selectively configurable into multiple configurations allowing the user to decide which configuration will work best for any desired exercise.

Overall, the first exercise bar 14 and the second exercise bar 20 extend radially and axially along a respective central axis and include an inner rigid member (e.g., a tube) and an outer member that surrounds the inner rigid member, the outer member is made of a material that has a high surface friction to provide for or create a "grip" when held in the user's hands. The first exercise bar 14 extends from a first end 16 to a second end 18 and includes a tube 28 (extending from the first end 16 to the second end 18), a grip surface 32, and a male central coupling 36. The tube 28 of the first exercise bar 14 forms the main portion of the support of the first exercise bar 14 and extends from the first end 16 to the second end 18 along a central axis 30A shown in FIG. 5. The tube 28 may be made of at least one of aluminum, stainless steel, steel, zinc, nickel, common metal alloys, and various polymers (e.g., polypropylene, polyethylene, polyvinyl chloride, polystyrene, etc.). In this way, the tube 28 provides the main portion of support for the first exercise bar 14 and prevents the first exercise bar 14 from significantly bending or breaking. Additionally, the first exercise bar 14 and the tube 28 are shown to include a circular cross section but may include a cross section having a different shape (e.g., triangular, square, rectangular, oblong/oval, etc.). In use and during assembly, the tube 28 is covered by the grip surface 32. The grip surface 32 extends from the first end 16 to the second end 18 and from the tube 28. In this way, the grip surface 32 also includes a circular cross section but may include a cross section having a different shape (as the grip surface 32 covers the tube 28, the cross section of the grip surface 32 is based on the tube 28) similar to the tube 28. The grip surface 32 is configured to be gripped by a user during use of the exercise bar device 10 and therefore is made of a material with a relatively high friction, or having a surface treatment that makes the grip surface have relatively high friction. As a result, the grip surface 32 may be made of at least one of silicone, rubber, various other polymers (e.g., polypropylene, polyethylene, polyvinyl chloride, polystyrene, etc.), and high friction metals. In this way and during use, the user may grab or grip the grip surface 32 of the first exercise bar 14 and not have their hand slip or slide on the exercise bar. This allows the user to better focus on their exercise and not have to constantly adjust their grip on the exercise bar.

Still referring to FIGS. 1-4, the first exercise bar 14 is shown to further include at least one hybrid end cap 50, at least one female end cap 75, at least one weight 100, and a slow loading mechanism 150. While operation and use of each will be described further herein, FIGS. 1-4 show the location of each relative to the first end 16 and the second end 18 of the first exercise bar 14. For example, the male central coupling 36 is located proximate the first end 16, the at least one hybrid end cap 50 is located proximate the second end 18, the at least one female end cap 75 is located proximate the first end 16, the at least one weight 100 is selectively coupled to the at least one hybrid end cap 50 proximate the second end 18 and is received by and within the tube 28, and the slow loading mechanism 150 is selectively coupled to the at least one hybrid end cap 50 and is coupled to the tube 28 proximate the second end 18.

As described herein, the exercise bar device 10 further includes the second exercise bar 20. The second exercise bar 20 extends from the third end 22 to the fourth end 24 and includes a tube 28, a grip surface 32, multiple hybrid end caps 50, at least one weight 100, and a slow loading mechanism 150. As will be discussed further herein, the second exercise bar 20 extends along and about a central axis 30B (FIG. 5), includes a female central coupling 37 in place of the male central coupling 36, and includes another hybrid end cap 50 in place of the female end cap 75. Otherwise, it should be understood that the components of the second exercise bar 20 (e.g., the tube 28, the grip surface 32, etc.) are similar and substantially the same as the components of the first exercise bar 14 and references made to the first exercise bar 14 are applicable to the second exercise bar 20 with the third end 22 replacing the first end 16 and the fourth end 24 replacing the second end 18. For example, the female central coupling 37 of the second exercise bar 20 is located proximate the third end 22, at least one hybrid end cap 50 is located proximate the third end 22 and the fourth end 24, the at least one weight 100 is selectively coupled to the at least one hybrid end cap 50 proximate the fourth end 24 and is received by and within the tube 28 of the second exercise bar 20, and the slow loading mechanism 150 is selectively coupled to the at least one hybrid end cap 50 and is coupled to the tube 28 proximate the fourth end 24.

Figure 5:
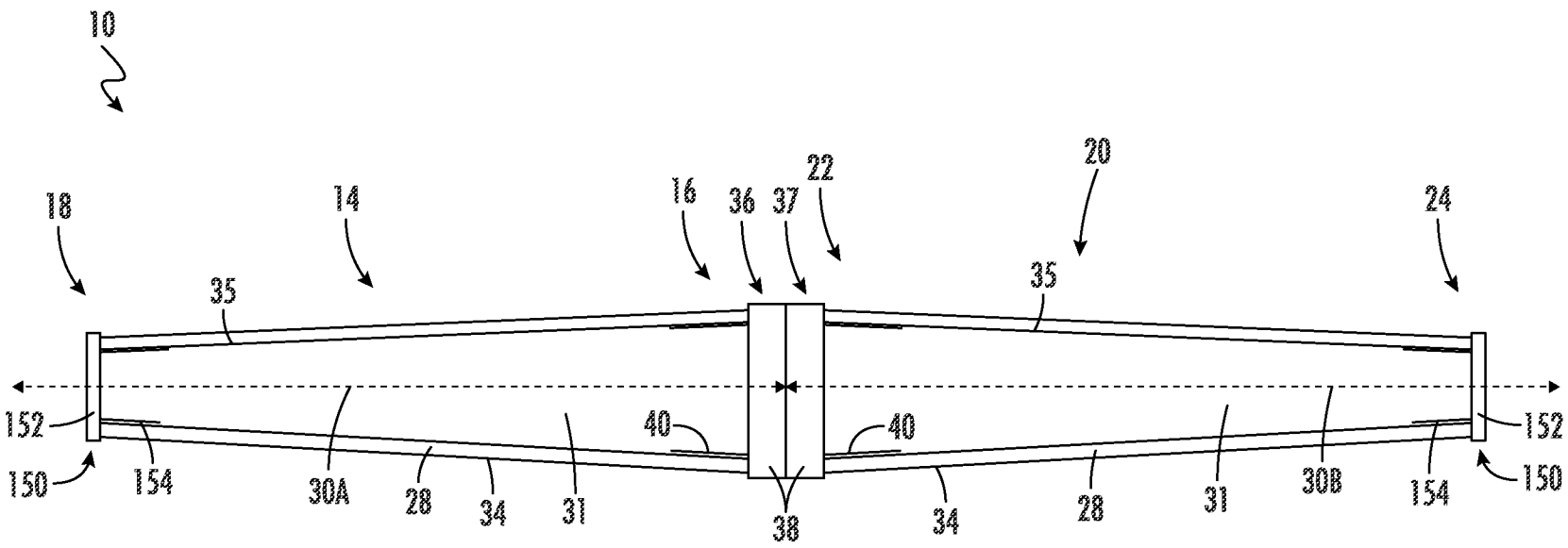
FIG. 5 is a schematic diagram of the exercise bar device of FIG. 1.

Referring now to FIG. 5, a schematic diagram of the exercise bar device 10 with the grip surfaces 32 removed is shown. In comparison to FIGS. 1-4, FIG. 5 shows both the interior of the first exercise bar 14 and the second exercise bar 20, provides emphasis to the slight taper of each tube 28, and also shows the apertures through which the weights 100 are received into and held by an interior cavity 31 of the first exercise bar 14 and the second exercise bar 20. In other words, the schematic diagram of the exercise bar device 10 of FIG. 5 shows exaggerated dimensions for purposes of illustration. The tubes 28 of the first exercise bar 14 and the second exercise bar 20 extend along and about the central axis 30A, 30B (which are collinear if the first exercise bar 14 and the second exercise bar 20 are selectively coupled) and each tube 28 includes a taper (e.g., a decrease in diameter) from the respective first and third ends 16, 22 to the respective second and fourth ends 18, 24. In this way, the respective tube 28 has a smaller diameter at the respective second and fourth ends 18, 24 and a larger diameter at the respective first and third ends 16, 22. Additionally, each tube 28 is hollow and therefore includes an inner diameter 35 defining a cavity 31 and an outer diameter 34. In some embodiments, the outer diameter 34 of each tube 28 is 27 millimeters (mm) at the respective second and fourth ends 18, 24 and is 31 mm at the respective first and third ends 16, 22. In other embodiments, the outer diameter 34 of each tube 28 is approximately 14-34 mm at the respective second and fourth ends 18, 24 and is about 16-46 mm at the respective first and third ends 16, 22. In even other embodiments, the inner diameter 35 of each tube 28 is 20 mm at the respective second and fourth ends 18, 24 and is 25 mm at the respective first and third ends 16, 22. In some embodiments, the inner diameter 35 of each tube 28 is about 10-30 mm at the respective second and fourth ends 18, 24 and is about 12-36 mm at the respective first and third ends 16, 22.

In some embodiments, the total length (along the central axis 30A, 30B) of the exercise bar device 10 is approximately 5 feet (ft) or 60 inches (in). In other embodiments, the total length of the exercise bar device 10 is approximately 3-7 ft. Similarly, each tube 28 may be approximately 2 ft in length. In other embodiments, each tube may be approximately 1-4 ft in length. By providing a relatively long exercise bar, the exercise bar device 10 is well suited for balance and strength exercises. For example, because the exercise bar device 10 may be approximately 5 ft in length, the user can better hold the exercise bar device 10 in both hands, and the bar is also much longer than the average width of a person's shoulders. This allows the exercise bar device 10 to extend horizontally out from a user's shoulder width and be used in a range of exercises.

Still referring to FIG. 5, each male and female central coupling 36, 37 is shown to include a body 38 and a connector 40. The body 38 is the main portion of the male and female central coupling 36, 37 that extends outwardly from and parallel to the respective central axis 30A, 30B. In one embodiment the body 38 is a pipe (or tube) made of aluminum, stainless steel, or other metals and that includes an outer diameter and a circular cross section. In even other embodiments, the outer diameter of the body 38 is approximately 33 mm. The connector 40 extends from the body 38 and couples the male or female central coupling 36, 37 to the tube 28. For example, the connector 40 may be received by the tube 28 (e.g., within the cavity 31) to couple the male or female central coupling 36, 37 to the tube 28. In this way, the connector 40 may be any type of connection, member, fastener, adhesive, etc. that is configured to be received by the tube 28 to provide a coupling. In one embodiment, the connector 40 is a tube made of a relatively rigid (e.g., hard to compress) metal or polymer that is press fit into the tube 28 to form a coupling between the central coupling 36 and the tube 28. In another embodiment, the connector 40 is a filler metal or adhesive that is brazed, welded, applied, or soldered to both the tube 28 and the male or female central coupling 36, 37 to couple each together. In even other embodiments, the connector 40 is a set of male and female threads e.g., the tube 28 including one of the male and female threads and the male or female central coupling 36, 37 including the other of the male and female threads) through which the central coupling 36 is coupled to the tube 28. In some embodiments, the connector 40 is integrally formed as a part of the body 38 (e.g., the body 38 includes the connector 40 extending therefrom). Additionally, while the connector 40 is shown as being tapered in FIG. 5, the connector 40 may also not be tapered (e.g., may be approximately straight). In other embodiments, the male and female central couplings 36, 37 are integrated as a part of (e.g., are cast as the same time and/or created as one piece with) the tubes 28.

Similar to the male central coupling 36, each slow loading mechanism 150 is shown to include a body 152 and a connector 154. The body 152, while different from the body 38, is the main portion of the slow load mechanism 150 that extends outwardly from and parallel to the respective central axis 30A, 30B. In one embodiment, the body 152 is a pipe made of aluminum, stainless steel, or other metals and that includes an outer diameter and a circular cross section. In even other embodiments, the outer diameter of the body 152 is approximately 29 mm. The connector 154 extends from the body 152 and couples the slow load mechanism to the tube 28. For example, the connector 154 may be received by the tube 28 (e.g., within the cavity 31) to couple the slow load mechanism 150 to the tube 28. In this way, the connector 154 may be any type of connection, member, fastener, adhesive, etc. that is configured to be received by the tube 28 to provide a coupling. In one embodiment, the connector 154 is a tube made of a relatively rigid (e.g., hard to compress) metal or polymer that is press fit into the tube 28 to form a coupling between the slow load mechanism 150 and the tube 28. In another embodiment, the connector 154 is a filler metal or adhesive that is brazed, welded, applied, or soldered to both the tube 28 and the slow load mechanism 150 to couple each together. In even other embodiments, the connector 154 is a set of male and female threads (e.g., the tube 28 including one of the male and female threads and the slow load mechanism 150 including the other of the male and female threads) through which the slow load mechanism 150 is coupled to the tube 28. In some embodiments, the connector 154 is integrally formed as a part of the body 152 (e.g., the body 152 includes the connector 154). Additionally, while the connector 154 is shown as being tapered in FIG. 5, the connector 154 may also not be tapered (e.g., may be approximately straight). In other embodiments, the slow loading mechanisms 150 are integrated as a part of (e.g., are cast as the same time and/or created as one piece with) the tubes 28.

Figure 6:
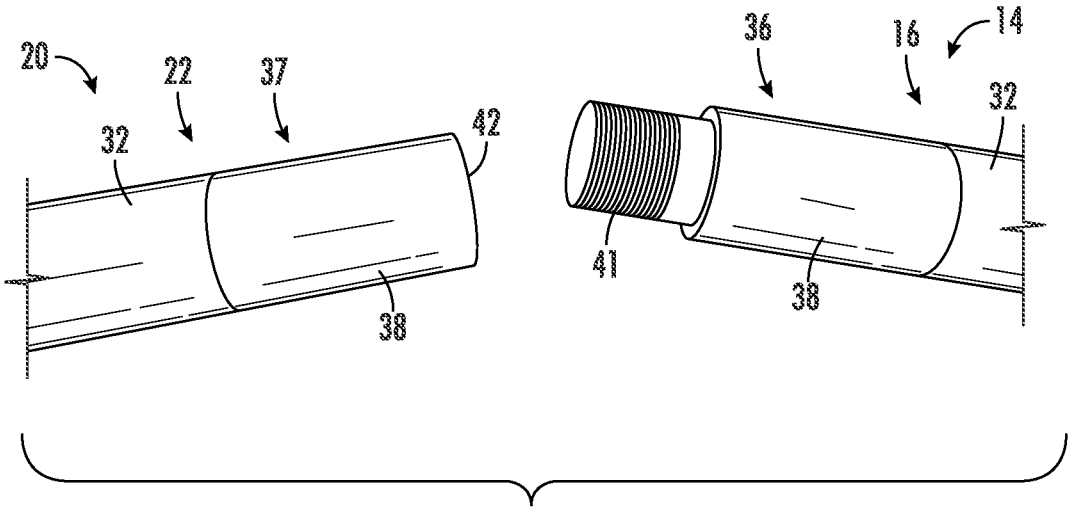
FIG. 6 is a close-up view of a male central coupling and a female central coupling of the exercise bar device of FIG. 1, according to one embodiment.
Figure 7:
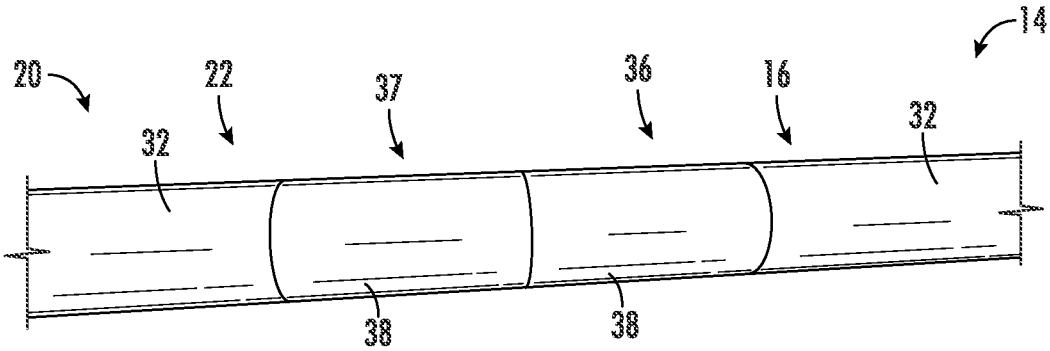
FIG. 7 is a close-up view of the male central coupling and the female central coupling of FIG. 6, according to one embodiment.

Referring now to FIGS. 6-7, the male and female central couplings 36, 37 of the first exercise bar 14 and the second exercise bar 20 are shown, according to one embodiment. The male and female central couplings 36, 37 are configured to selectively couple to the opposite male or female central coupling 36, 37 such that the user can easily couple and then uncouple the first exercise bar 14 to the second exercise bar 20. Each of the male and female central couplings 36 includes the body 38, the connector 40, and at least one of a male threaded coupling 41 and a female threaded coupling 42 (e.g., the male central coupling 36 includes the male threaded coupling 41 and the female central coupling 37 includes the female threaded coupling 42). In the embodiment shown, the first exercise bar 14 includes the male central coupling 36 and therefore the male threaded coupling 41, and the second exercise bar 20 includes the female central coupling 37 and therefore the female threaded coupling 42. In other embodiments, this may be switched (e.g., the first exercise bar 14 may include the female central coupling 37 and therefore the female threaded coupling 42 and vice versa). The female threaded coupling 42 is integrated within (e.g., is located within a cavity of) the body 38 and includes female threads. The male threaded coupling 41 extends from the body 38 as a round pipe or tube and includes male threads that are received by and screwed into and the female threads with the same pitch and diameter (e.g., the female threads of the female threaded coupling 42). As a result, each of the male threaded coupling 41 and the female threaded coupling 42 are configured to be selectively coupled to the other threaded coupling (e.g., a male thread couples to a female thread and vice versa). In this way, and to selectively couple the first exercise bar 14 to the second exercise bar 20, the user only has to screw the male threaded coupling 41 of the first exercise bar 14 into the female threaded coupling 42 of the second exercise bar 20, as shown in FIG. 7.

In operation and during or in between an exercise, the user can use the male and female central couplings 36, 37 of the first exercise bar 14 and the second exercise bar 20 to change configurations of the exercise bar device 10. Together, the male and female central couplings 36, 37 selectively couple the first exercise bar 14 and the second exercise bar 20. In this way and during use, the user can decide whether to use the exercise bar device 10 as a long single bar (e.g., with the first exercise bar 14 coupled to the second exercise bar 20), as a short single bar (e.g., with just the first exercise bar 14 or just the second exercise bar 20 decoupled from the other), or as two separate exercise bars (e.g., with both the first exercise bar 14 and the second exercise bar 20 as separate bars decoupled from one another). To move between configurations, the user only has to uncouple the male threaded coupling 41 from the female threaded coupling 42 (e.g., unscrew the male threaded coupling 41 from the female threaded coupling 42), or couple the male threaded coupling 41 to the female threaded coupling 42 (e.g., screw the male threaded coupling 41 into the female threaded coupling 42). As a result, the exercise bar device 10 is configurable between various exercise configurations.

Figure 8:
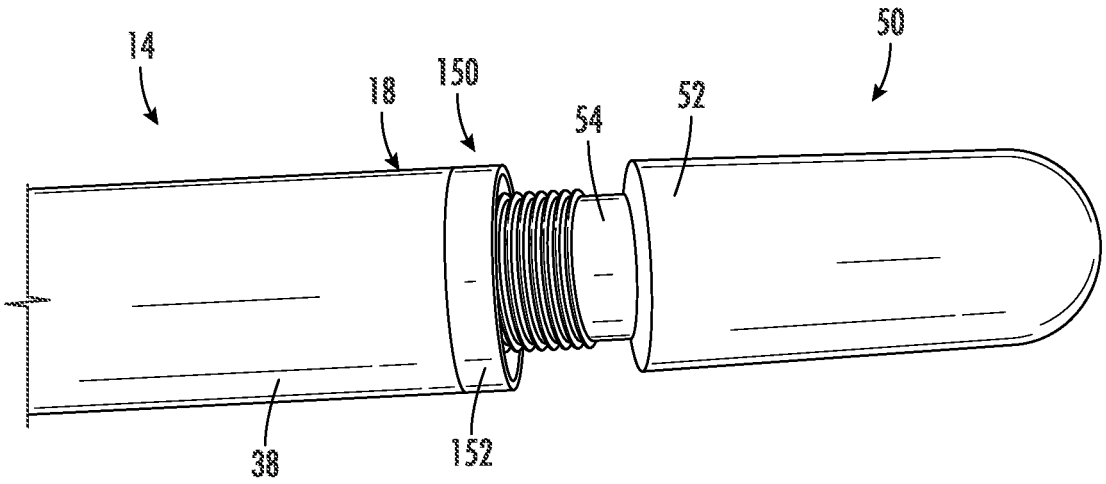
FIG. 8 is a close-up view of a hybrid end cap of the exercise bar device of FIG. 1, according to one embodiment.
Figure 9:
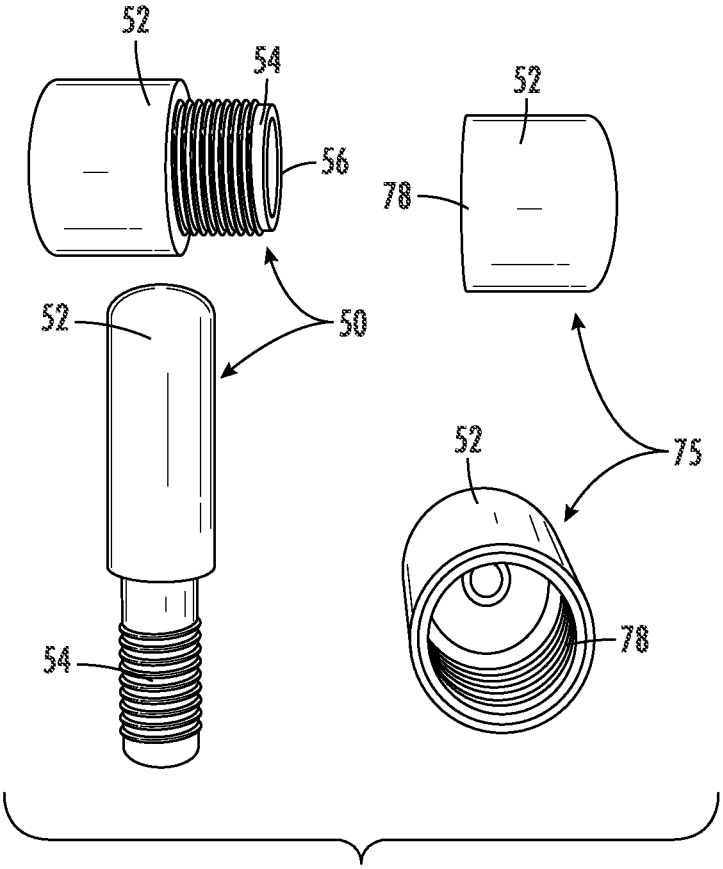
FIG. 9 depicts various view of the hybrid end cap of FIG. 7 and a female end cap of the exercise bar device of FIG. 1, according to one embodiment.
Figure 10:
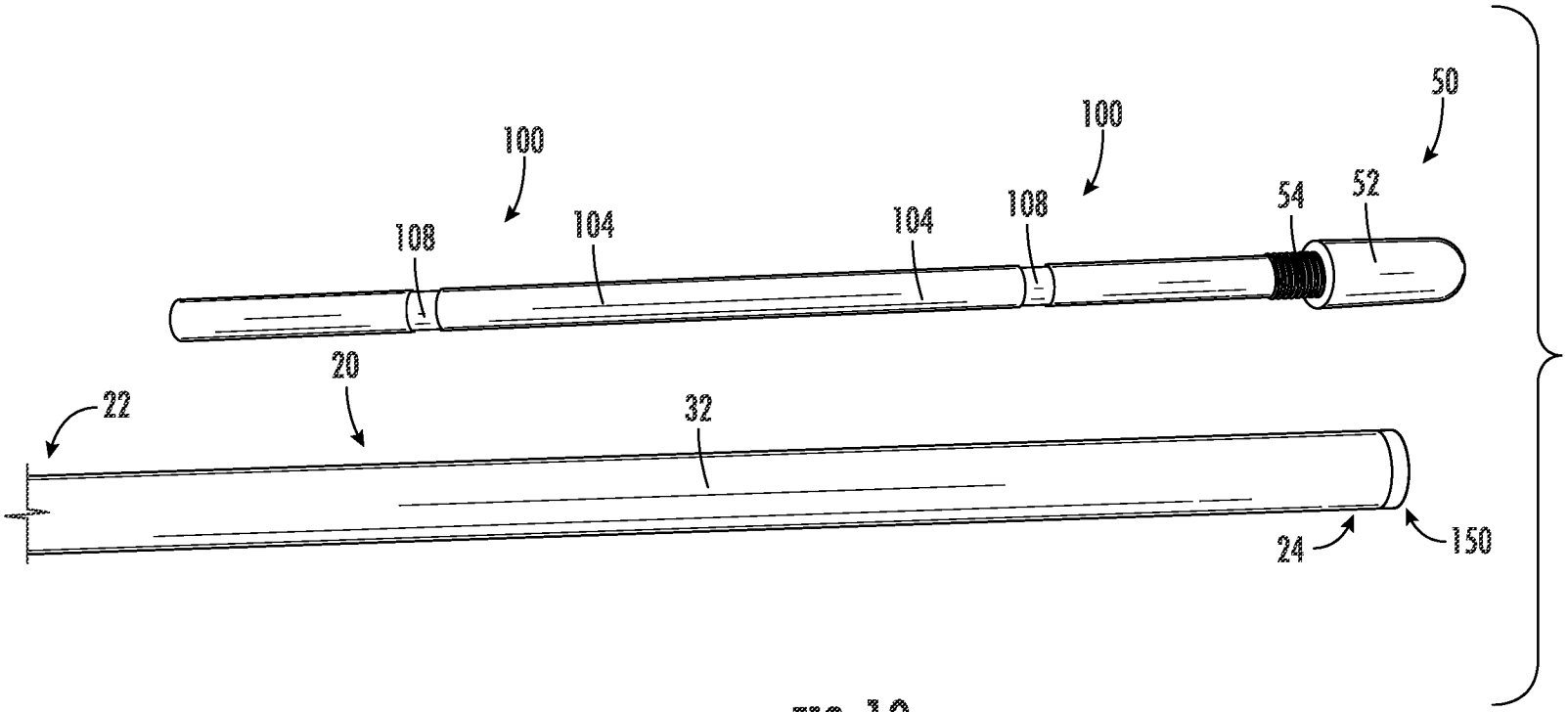
FIG. 10 is a perspective view of two weights of the exercise bar device of FIG. 1 coupled together and an exercise bar ready to receive the weights, according to one embodiment.
Figure 11:
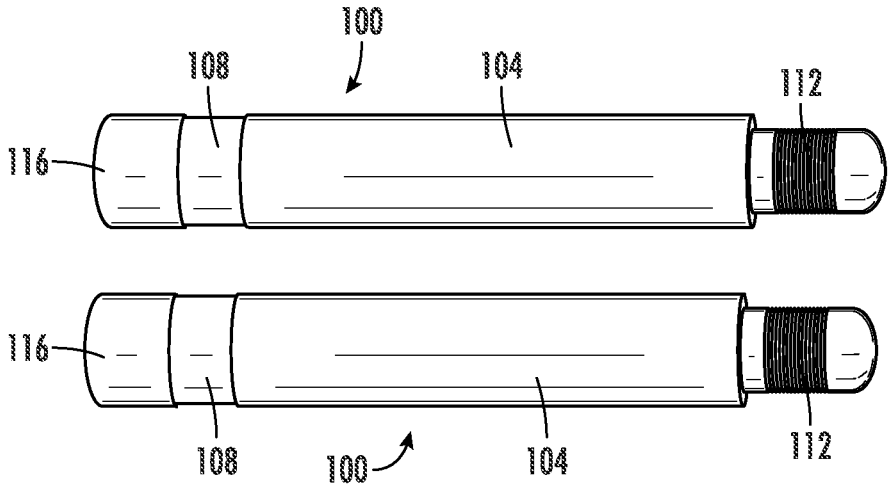
FIG. 11 is a top view of the two weights of FIG. 10.
Figure 12:
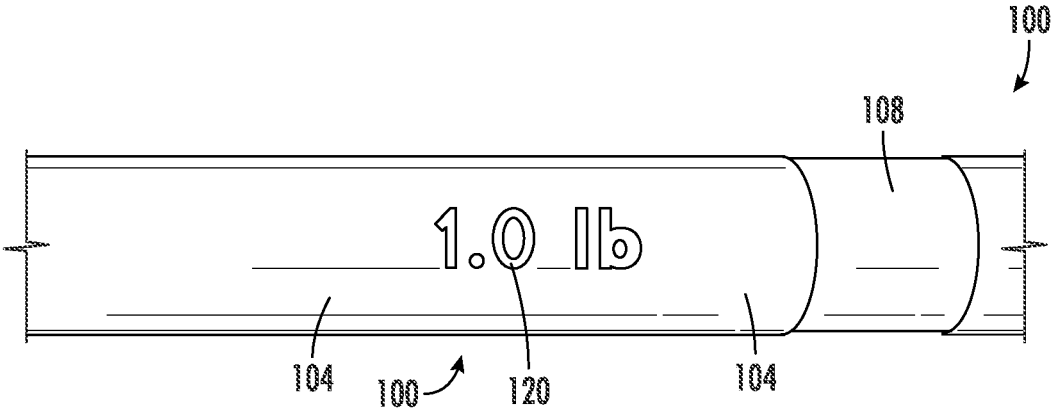
FIG. 12 is a close-up view of one of the weights of FIG. 10.
Figure 13:
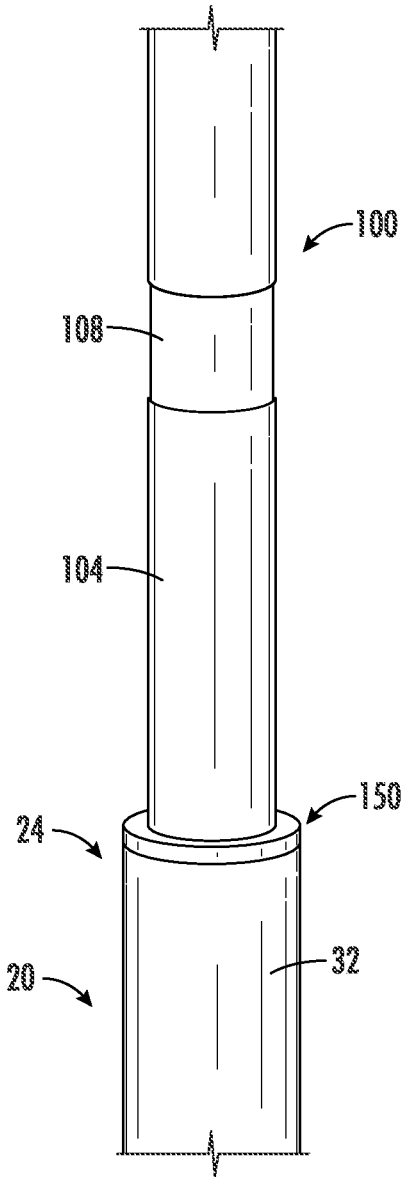
FIG. 13 is a close-up view of one of the weights of FIG. 10 being received within the exercise bar of FIG. 1.
Figure 14:
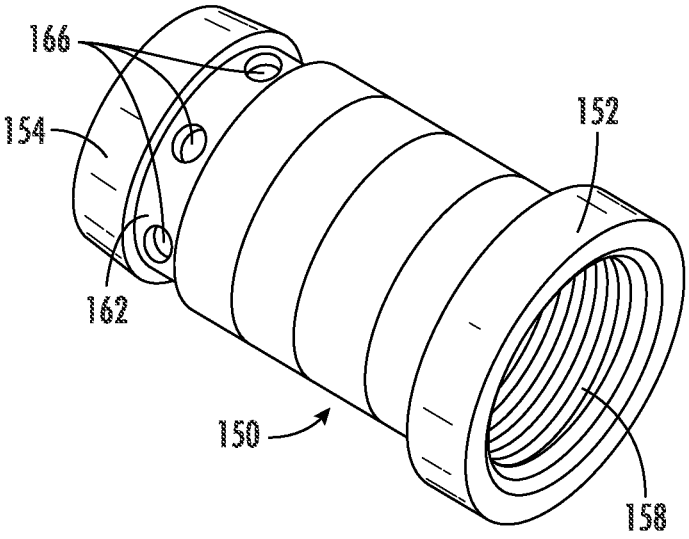
FIG. 14 is a perspective view of a slow loading mechanism of the exercise bar device of FIG. 1, according to one embodiment.
Figure 15:
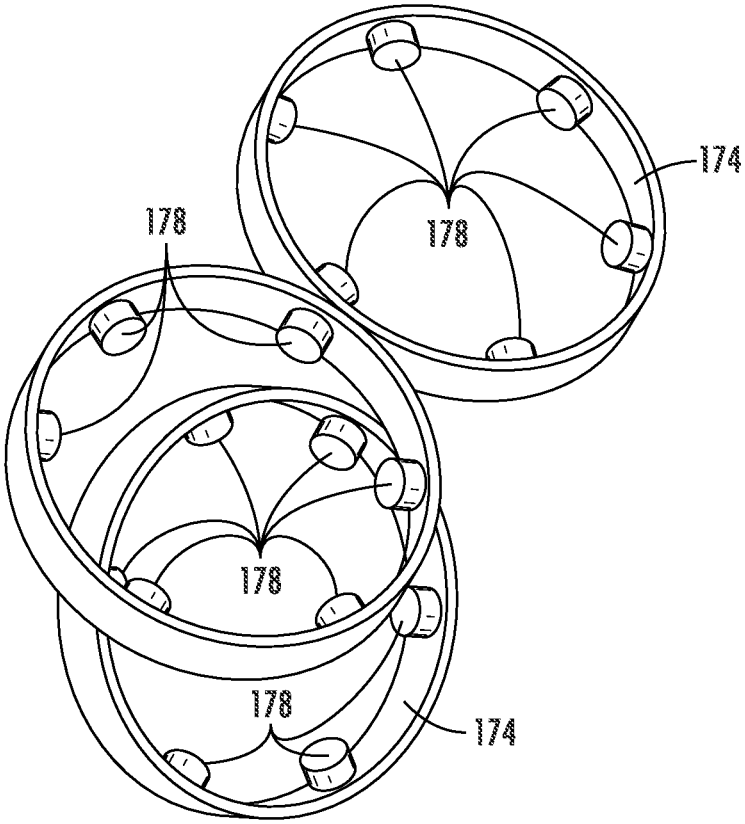
FIG. 15 is a perspective view of multiple flexible rings of the slow loading mechanism of FIG. 14, according to one embodiment.

Referring now to FIGS. 8-9, the hybrid end cap 50 and the female end cap 75 are shown, according to one embodiment. In some embodiments, the exercise bar device 10 includes approximately three hybrid end caps 50 and one female end cap 75. The second exercise bar 20 may include two hybrid end caps 50 (FIG. 2), with one hybrid end cap 50 selectively coupled to the central coupling 36 proximate the third end 22 and another hybrid end cap 50 selectively coupled to the slow loading mechanism 150 proximate the fourth end 24. In other embodiments, there may be different numbers of hybrid end caps 50 and female end caps 75 (e.g., three female end caps 75 and one hybrid end cap 50, two female end caps 75 and two hybrid end caps 50, etc.). Similarly, the first exercise bar 14 may include a single hybrid end cap 50 selectively coupled to the slow loading mechanism 150 proximate the second end 18 and a single female end cap 75 selectively coupled to the central coupling 36 proximate the first end 16. In even other embodiments, the first exercise bar 14 may include two hybrid end caps 50, and the second exercise bar 20 may include a single hybrid end cap 50 and a single female end cap 75. Additionally, it should be understood that when the exercise bar device 10 is formed by coupling the first exercise bar 14 and the second exercise bar 20 together, at least one of the hybrid end caps 50 of the second exercise bar 20 and the female end cap 75 of the first exercise bar 14 are removed.

Each hybrid end cap 50 is configured to be selectively coupled to at least one of the slow loading mechanism 150, the female central coupling 37, and one or more weights 100 to provide a slightly rounded edge and a relatively soft surface (as compared to if the hybrid end caps 50 were not included) as well as to selectively couple the weights 100 to the exercise bar device 10. In this way, the hybrid end caps 50 (along with the female end cap 75) seal and further define the cavities 31. Each hybrid end cap 50 includes a rounded portion 52, a male threaded coupling 54 (which may include the same pitch and diameter as the male threaded coupling 41), and a female threaded coupling 56 located within the male threaded coupling 54 (e.g., the hybrid end cap 50 is "hybrid" as it includes both male and female threads). The rounded portion 52 extends from the male threaded coupling 54 and includes a rounded face. The rounded portion 52 may be made of a soft material (e.g., Low-Density Polyethylene, Nylon, rubber, various types of gel, etc.) to provide a relatively soft and rounded edge. In this way and in operation, the user does not need to worry about catching the ends of the exercise bar device 10 on the floor, an exercise mat, or themselves. In other embodiments, various other types and shapes of faces may be implemented (e.g., blunt, hard, etc.).

The male threaded coupling 54 extends (e.g., includes a pipe or tube that extends) from the rounded portion 52 and includes male threads that are received by female threads with the same pitch and diameter. In this way, the male threaded coupling couples to female threads of the slow loading mechanisms 150 or the female central coupling 37 and therefore at least one of the first exercise bar 14 and the second exercise bar 20. Within the male threaded coupling 54, the hybrid end cap 50 includes a bore within which the female threaded coupling 56 is formed. In this way, the hybrid end cap 50 can both be selectively coupled to at least one of the slow loading mechanism 150 and the female coupling 37 as well as to one or more of the weights 100 (e.g., via a male thread of the weights 100). As the female threads of the female threaded coupling 56 are formed inside of the male threaded coupling, the female threads may have a smaller diameter than the male threads of the male threaded coupling 54.

In use and to add weight to at least one of the first exercise bar 14 and the second exercise bar 20, the user may selectively couple one or more weighs 100 to the hybrid end cap 50 (e.g., via the female threaded coupling 56). Once the weights 100 are coupled to the hybrid end cap 50, the user may then insert the weights 100 into the cavity 31 until the male threaded coupling 56 comes into contact with the female threads of the female central coupling 37 or the slow loading mechanism 150. Then, using the male threaded coupling 56, the user may selectively couple the hybrid end cap 50 (as well as the weights 100) to the female central coupling 37 or the slow loading mechanism 150 and therefore to at least one of the first exercise bar 14 and the second exercise bar 20. By selectively coupling different sizes or amounts of the weights 100, the user can select and adjust the weight of each of the first exercise bar 14 and the second exercise bar 20, and together the exercise bar device 10. As a result, not only can the user decide what configuration of the exercise bar device 10 is best for their desired exercise, but also how much weight is best for their desired exercise.

Still referring to FIGS. 8-9, the female end cap 75 is shown in more detail. The female end cap 75 is similar to the hybrid end cap 50 and serves a similar purpose to provide a relatively soft/rounded surface as compared to if the female end cap 75 were not included. The female end cap 75 is configured to selectively couple to the male central coupling 36. In some embodiments (e.g., where the slow load mechanisms 150 includes a male threaded coupling), the female end cap 75 may be configured to selectively couple to the slow load mechanism 150. To couple to the male central coupling 36, the female end cap includes the rounded portion 52, and a female threaded coupling 78 (which may include the same pitch and diameter as the female threaded coupling 42). The female threaded coupling 78 is formed as a bore within the rounded portion 52 and includes female threads. The female threads of the female threaded coupling 78 may be configured to selectively couple to male threads of the male threaded coupling 41 (or the male threaded coupling 54 if desired). The female threads of the female threaded coupling 78 may include a similar diameter or pitch as the respective male threads.

When the user wants to use the first exercise bar 14 and/or the second exercise bar 20 decoupled from one another, the user can use the hybrid end caps 50 to cap or cover the female threads of the slow load mechanism 150 as well as the female central coupling 37. In some embodiments, should the female threads of the female threaded coupling 56 be too small (i.e., they include a smaller diameter) to selectively couple and cap the male central coupling 36, the female end cap 75 can include female threads with similar diameter and pitch as the male threads of the male central coupling 36. In such embodiments, to use the first exercise bar 14 and/or the second exercise bar 20 decoupled from one another, the user selectively couples a first hybrid end cap 50 to the slow load mechanism 150 proximate the second end 18, a second hybrid end cap 50 to the slow load mechanism 150 proximate the fourth end 24, a third hybrid end cap 50 to the female central coupling 37 proximate the third end 22, and a female end cap 75 to the male central coupling 36 proximate the first end 16 (in any order).

In some embodiments, the weight of the male central coupling 36, the female end cap 75, and the single hybrid end cap 50 of the first exercise bar 14, combined, is equal to the weight of the female central coupling 37 and the two hybrid end caps 50 of the second exercise bar 20, combined. As a result, the weight of the first exercise bar 14 and the second exercise bar 20 are the same when decoupled from one another. Beneficially, because the weight of the first exercise bar 14 and the second exercise bar 20 is the same, the exercise bars 14, 20 are better suited for balance exercises over traditional exercise equipment. For example, if the user were to use the first exercise bar 14 and the second exercise 20 decoupled from one another, both exercise bars 14, 20 are the same weight and therefore do not tip the user's balance towards one bar over the other. This is similarly beneficial for strength and conditioning exercises, in which a user wants to lift and move the same amount of weight in each hand to train both sets of muscles using the same weight. However, should the user desire to train each hand using a different weight, the user can load a different amount of weight into one of the first exercise bar 14 or the second exercise bar 20. This versatility also enables the user to load a different amount of weight in one of the first exercise bar 14 and the second exercise bar 20, and couple the first exercise bar 14 and the second exercise bar 20 together such that the exercise bar device 10 includes an uneven or lopsided distribution of weight.

Referring now to FIGS. 10-13, the weights 100 are shown, according to one embodiment. The weights 100 are configured to be received within the cavities 31 of the first exercise bar 14 and the second exercise bar 20 to adjust the overall weight of the exercise bars 14, 20 and together the exercise bar device 10. In this way, the user can selectively couple single or multiple weights 100 to one or more hybrid end caps 50 and then insert the weights 100 into the cavities 31. The weights 100 can come in a variety of sizes and weights, including approximately 0.5 pounds (lb), approximately 1 lb, approximately 1.5 lbs, approximately 2 lbs, approximately 3 lbs, approximately 4 lbs, approximately 5 lbs, all the way up to approximately 10 lbs (e.g., in one pound increments, half pound increments, etc.). Each weight 100 includes a weight bar 104 that extends about and along a central axis (not shown, but collinear with the central axis 30A, 30B when inserted into the cavity 31 and selectively coupled to the first exercise bar 14 or second exercise bar 20). The weight bar 104 may be made of a variety of metals (e.g., aluminum, stainless steel, steel, zinc, and other metals or polymers disclosed herein). Additionally, the weight bar 104 may include a circular cross section and include an outer diameter that is slightly smaller than the inner diameter 35 of the tube 28. For example, the weight bar 104 may include an outer diameter of approximately 9-30 mm or approximately 18 mm, 18.5 mm, 19 mm, 19.25 mm, 19.5 mm, 19.8 mm, 19.9 mm, 19.9 mm, etc. In some embodiments, the weight bar 104 of the weight 100 has a slight taper from one end to another (similar to the tube 28). In some embodiments, the weight bar 104 may include a different shaped cross section (similar to those discussed with respect to the tube 28).

In some embodiments, the weight bar 104 and therefore the weights 100 further include a groove 108 (e.g., channel, taper, depression) that includes a smaller outer diameter than the rest of the weight bar 104. The groove 108 is used in combination with the slow loading mechanism 150 to provide a momentary increase in loading speed of the weights 100. The groove 108 may be a slight groove (e.g., a slight decrease in outer diameter of the weight bar 104, a taper, etc.) or may be a more significant groove (e.g., a sharp decrease in outer diameter of the weight bar 104, a notch, etc.). In some embodiments, the outer diameter of the weight bar 104 in the groove 108 is approximately 8-29 mm or approximately 17 mm, 17.5 mm, 18 mm, 18.5 mm, or 18.9 mm. In some embodiments, the weight bar 104 may include multiple grooves 108 (e.g., two, three, four, etc.), each groove 108 allowing and configured to provide a momentary (depending on the length of the groove 108) increase in loading speed of the weights 100.

Each weight 100 may be approximately 1 ft in length. In some embodiments, each weight may be approximately 6-24 inches in length. In this way, each weight 100 (e.g., or multiple weights 100 coupled together) are similar in length to the tube 28 of the first exercise bar 14 and the second exercise bar 20. It is beneficial, in regards to balance exercises, for the weights 100 to be similar in length to the tube 28. For example, because the weights 100 extend most of the length of the tube 28 (when received in the cavity 31), the weight of the weights 100 is better distributed along the length of the tube 28 and therefore the first exercise bar 14 and the second exercise bar 20 than the weight would otherwise be distributed should the weights 100 be shorter in length. This allows a user to more easily balance the exercise bar device 10. In this way, each cavity 31 may be configured to receive multiple weights 100 (e.g., 1 weight, 2 weights, 3 weights, etc.) before being full.

Still referring to FIGS. 10-13, each weight 100 further includes a male threaded coupling 112 (which may be similar in diameter and pitch to the female threaded coupling 56 of the hybrid end cap 50), a female threaded coupling 116 (which also may be similar in diameter and pitch to the female threaded coupling 56), and an insignia 120 which may include information relating to the weights 100 (e.g., "1 pound", "1 lb", etc.). The male threaded coupling 112 is configured to selectively couple the weight 100 to at least one of another weight 100 (e.g., via the female threaded coupling 116) and the hybrid end cap 50 (e.g., via the female threaded coupling 56). In this way, each weight 100 is configured to couple to another weight 100, which is capable of coupling to another weight 100, and so on. In use, the size of the cavity 31 (which depends on the length of the tube 28) and the length of each weight 100 are the limiting factors on how many weights 100 can be combined together within each of the first exercise bar 14 and the second exercise bar 20. As a result, (depending on the size of the cavity 31) the user may selectively couple multiple weights 100 together, and then selectively couple the combined weights 100 (e.g., via the male threaded coupling 112 of one of the weights 100) to the hybrid end cap 50. The user may then insert the combined weights 100 into the cavity 31, allow the weight 100 to drop into place via the slow loading mechanism 150, and then selectively couple the hybrid end cap 50 to at least one of the slow loading mechanism 150 and the female central coupling 37 (via the male threaded coupling 54). In this way, the user can selectively couple the weights to and insert the weights into cavity 31 of the first exercise bar 14 or the second exercise bar 20 to adjust the weight of the exercise bars 14, 20 or to adjust the weight of the combined exercise bar device 10.

Referring now to FIGS. 14-17, the slow loading mechanism 150 is shown, according to one embodiment. As used herein "slow loading mechanism" relates to any type of device, mechanism, item, component, that is configured to decelerate the weights 100 when the weights are dropped into the tube 28 of the exercise bars 14, 20 such that the weights 100 move at a rate that is slower than if the slow loading mechanism 150 were not included. The slow loading mechanism 150 is configured to receive the weights 100 and to slow the weights 100 as the weights 100 descend into the cavity 31. Each slow loading mechanism 150 includes the body 152, the connector 154, a female threaded coupling 158, a groove 162, and multiple circumferential apertures 166. The body 152 has the largest outer diameter of the slow loading mechanism 150. In this way and when received by the tube 28, the connector 154 is received up by the cavity 31 up to the body 152. The body 152 is larger than the inner diameter 35 (and possibly the outer diameter 34 in some embodiments) and therefore cannot be received within the cavity 31. Both the body 152 and the connector 154 include an inner diameter and outer diameter, and therefore the slow loading mechanism 150 is hollow. The connector 154 is a pipe extending from the body 152 and enables the slow loading mechanism 150 and the tube 28 to couple to one another (e.g., by sliding the connector 154 into the tube 28). In the embodiment shown, the connector 154 is formed as a part of the body 152 to couple the slow loading mechanism 150 and the tube 28. In one embodiment, to assemble the slow loading mechanism 150, the connector 154 is press fit into the tube 28 and thereby forms a fixed coupling. In other embodiments, a filler metal or adhesive is applied to each of the connector 154 and the tube 28 and then the connector 154 is inserted into the tube 28, thereby forming a fixed coupling between the slow loading mechanism 150 and the tube 28. In other embodiments, the slow loading mechanism 150 may be coupled to the tube 28 using other methods that are known in the art.

The groove 162 (e.g., channel, taper, depression) is formed as a part of the body 152 (e.g., formed as a groove within the connector 154 of the body 152) and includes the multiple circumferential apertures 166 formed therein. The groove 162 is a portion of the body 152 in which the outer diameter of the body 152 is less than the surrounding portions. The groove 162 further defines the multiple circumferential apertures 166 ("circumferential" here refers to the apertures 166 being located along the circumference of the groove 162). The apertures 166 provide an opening between the outside diameter of the body 152 and the hollow inner portion of the body 152. While each slow loading mechanism 150 is shown to include approximately 6 circumferential apertures 166, it will be appreciated that the slow loading mechanism 150 may include additional or fewer circumferential apertures 166. For example, each slow loading mechanism 150 may include 1, 2, 3, 4, 5, 8, 10, or more circumferential apertures 166.

The female threaded coupling 158 is formed within the body 152 and includes female threads (e.g., that may be the same diameter and pitch as the male threads of the male threaded couplings 41 and 54) configured to selectively couple to the male threaded couplings 41 and 54. In this way and as described herein, the slow loading mechanism 150 is coupled to the tube 28 via the connector 154 and can be selectively coupled to the male central coupling 36 or the hybrid end cap 50 (and possibly the weights 100). By including the variety of threaded couplings described herein, the exercise bar device 10 is highly configurable, allowing the user to remove and couple the different components in various ways.

Figure 16:
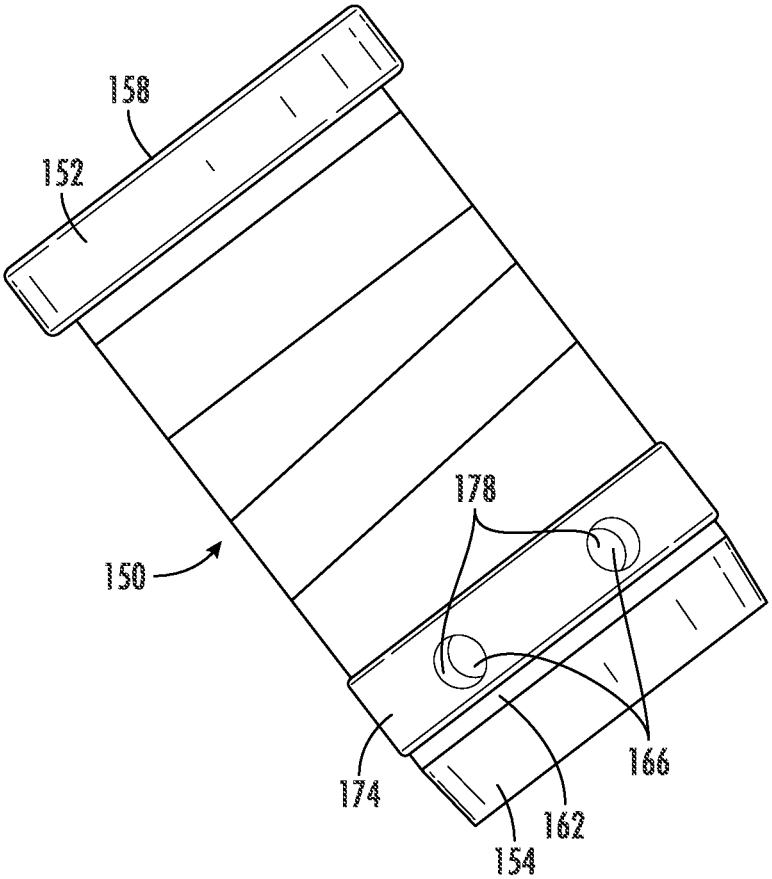
FIG. 16 is a close-up view of the slow loading mechanism of FIG. 14 coupled with one of the flexible rings of FIG. 15.
Figure 17:
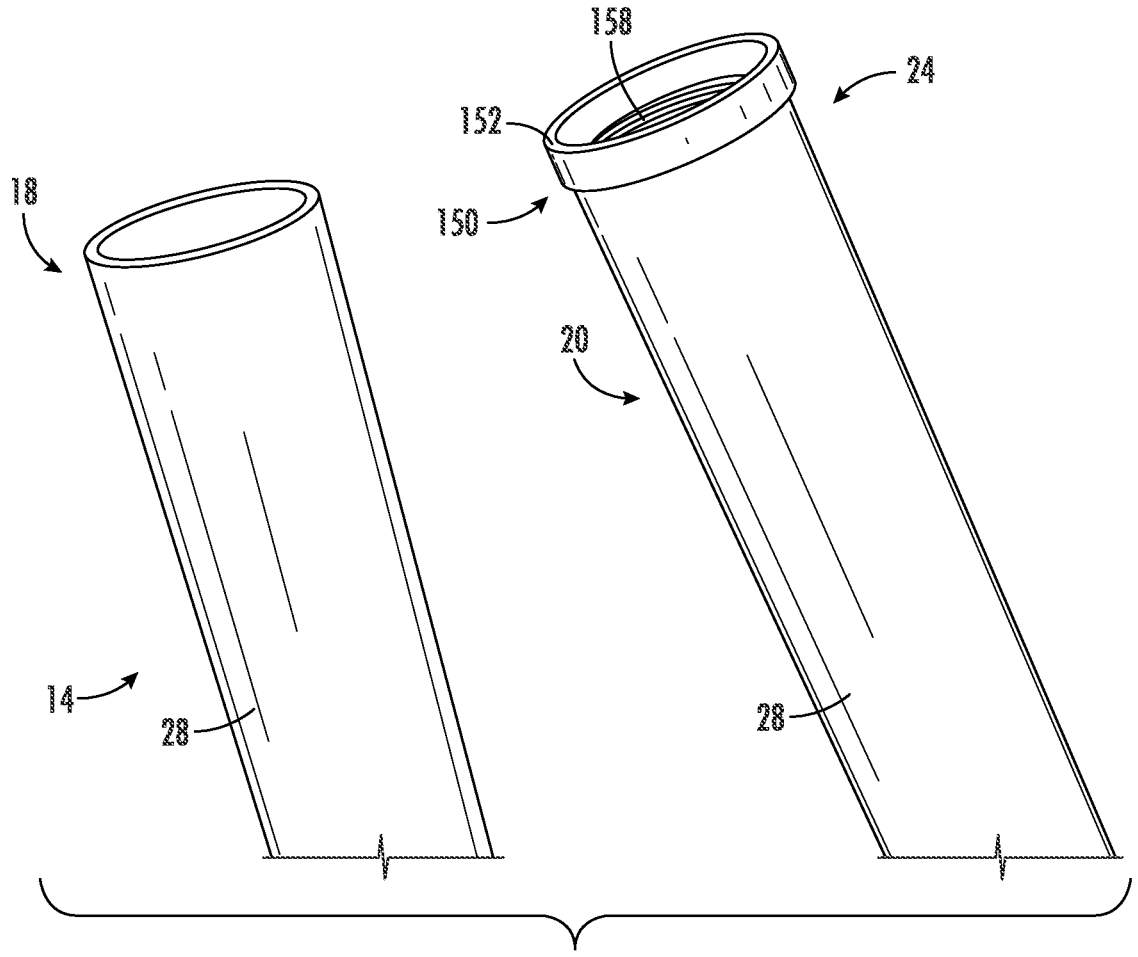
FIG. 17 is a close-up view of the slow loading mechanism of FIG. 14 installed into one end of the exercise bar device of FIG. 1.

Still referring to FIGS. 14-17, the slow loading mechanism 150 is further shown to include a flexible ring 174 and one or more grip members 178 extending radially inward from the ring 174. The ring 174 is elastic and is therefrom made from one or more elastic materials with relatively high friction (e.g., silicone, rubber, polypropylene, polyethylene, polyvinyl chloride, polystyrene, etc.). The ring 174 includes an inner diameter and an outer diameter and is configured to be seated in the groove 162. The grip members 178 extend radially inward from the inner diameter of the ring 174 and are configured to be received by and within the apertures 166 such that the grip members 178 extend radially inward of and within the cavity of the body 152 (FIG. 16). As a result and when each grip member 178 is received by a respective aperture 166, the grip member 178 comes into contact and provides a slowing force (e.g., a friction force opposing movement) to each weight 100 as the weight 100 is loaded into the cavity 31. Additionally, because each grip member 178 is located circumferentially about and extends radially inward toward the center of the slow loading mechanism 150, the grip members 178 provide an evenly applied slowing force to each weight 100. By doing so, the entire weight 100 (e.g., the outer circumference of the weight bar 104) receives the slowing force from the grip member 178 and is loaded much slower (e.g., 2, 3, 4, 5, 6, etc. times slower than if the slow loading mechanism 150 was not included).

Additionally and as described herein, the grip members 178 are configured to extend radially inward (e.g., within the body 152) such that they contact the outer diameter of the weight bar 104 but do not contact the outer diameter of the groove 108. In this way, loading of each weight 100 is slowed relative to gravity, but the weights 100 can also load without the resistive force of the slow loading mechanism 150 for some length of the weight bar 104 based on the length of the groove 108. Additionally and in some embodiments, each grip member 178 may include a relatively high friction half and a relatively low friction half such that the grip member 178 provides for relatively slow loading of each weight 100 but normal (e.g., same or similar speed to gravity, without resistance) unloading of each weight 100, or vice versa depending which direction each half of the grip member 178 faces). To create a relatively high friction half and a low friction half, each grip member 178 may include a high friction surface coating or be made of one or more materials (e.g., a high friction material and a low friction material). In some embodiments, the ring 174 can be replaced should any of the grip members 178 become worn.

The slow loading mechanism 150 further enables the weights 100 to be received by the cavity 31 such that the weights 100 are kept separate of the tube 28, thereby preventing damage to the weights 100 and tube 28. In embodiments where the slow loading mechanism 150 is not included, the weights 100 can accelerate to a relatively faster speed during loading such that the weights 100 "crash" into the cavity 31, which can cause damage to the first exercise bar 14, the second exercise bar 20, the weight 100, or other components of each. Inclusion of the slow loading mechanism 150 solves this problem by slowing the weights 100 and centering the weights 100 as the weights 100 are loaded into the first exercise bar 14 and the second exercise bar 20. The slow loading mechanism 150 slows the movement of the weights 100 enough such that the weights 100 are loaded at a speed where there is no crash or other damage to any components of the exercise bar device 10.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

What is claimed is:

1. An exercise device comprising:

a first exercise bar comprising:

a first tube extending from a first end to a second end and defining a first cavity;

a first weight configured to be selectively received within the first cavity; and a first slow loading mechanism coupled to the first tube proximate the second end and configured to contact the first weight when the first weight is received by the first cavity to provide a friction force to the first weight to slow the loading of the first weight into the first cavity, the first slow loading mechanism comprising:

a body defining a slow loading cavity, the body having a first groove including a plurality of apertures; and a ring coupled to the body such that the ring is at least partially located within the first groove, the ring including a plurality of grip members, each grip member received by at least one aperture of the plurality of apertures and extending at least partially into the slow loading cavity to contact the first weight when the first weight is received by the first cavity.

2. The exercise device of claim 1, further comprising:

a second exercise bar comprising:

a second tube extending from a third end to a fourth end and defining a second cavity, the second tube configured to selectively couple to the first tube proximate the first and third ends;

a second weight configured to be selectively received within the second cavity; and a second slow loading mechanism coupled to the second tube proximate the fourth end and configured to contact the second weight when the second weight is received by the second cavity to provide a friction force to the second weight to slow the loading of the second weight into the second cavity.

3. The exercise device of claim 2, wherein the body is a first body, the slow loading cavity is a first slow loading cavity, the ring is a first ring, the plurality of apertures is a plurality of first apertures, and the plurality of grip members is a plurality of first grip members, and wherein the second slow loading mechanism comprises:

a second body defining a second slow loading cavity, the second body having a second groove including a plurality of second apertures; and a second ring coupled to the second body such that the second ring is at least partially located within the second groove, the second ring including a plurality of second grip members, each second grip member received by at least one second aperture of the plurality of second apertures and extending at least partially into the second slow loading cavity to contact the second weight when the second weight is received by the second cavity.

4. The exercise device of claim 1, wherein the first weight includes a second groove, and wherein the grip members are configured to not contact a surface of the second groove of the first weight when the first weight is received by the first cavity.

5. The exercise device of claim 1, wherein the first exercise bar further comprises a second weight selectively coupled to the first weight.

6. The exercise device of claim 1, wherein the first tube is tapered between the first end and the second end such that an outer diameter of the first tube decreases from the first end to the second end.

7. An exercise device comprising:

a first tube extending from a first end to a second end and defining a first cavity;

a second tube extending from a third end to a fourth end and defining a second cavity, the second tube configured to selectively couple to the first tube proximate the first and third ends;

a first weight configured to be selectively received within the first cavity;

a second weight configured to be selectively received within the second cavity;

a first slow loading mechanism coupled to the first tube and configured to slow the loading of the first weight into the first cavity, the first slow loading mechanism including a first ring having a plurality of first grip members;

a second slow loading mechanism coupled to the second tube and configured to slow the loading of the second weight into the second cavity, the second slow loading mechanism including a second ring having a plurality of second grip members;

a first end cap selectively coupled to the first weight and the first tube; and a second end cap selectively coupled to the second weight and the second tube.

8. The exercise device of claim 7, further comprising:

a third weight selectively coupled to the first weight; and a fourth weight selectively coupled to the second weight.

9. The exercise device of claim 7, wherein the first slow loading mechanism and the second slow loading mechanism are configured to slow the loading of a respective weight by friction.

10. The exercise device of claim 7, wherein the first slow loading mechanism and the second slow loading mechanism both include a body configured to hold the respective ring in place within the respective tube.

11. The exercise device of claim 7, wherein the first weight is configured to screw into the first end cap, and wherein the first end cap is configured screw into the first tube after the first weight is inserted into the first tube.

12. The exercise device of claim 7, wherein an outer diameter of the first tube at the first end is a first diameter, and wherein an outer diameter of the first tube at the second end is a second diameter, wherein the second diameter is less than the first diameter.

13. An exercise device comprising:

a first exercise bar comprising:

a first tube extending from a first end to a second end and defining a first cavity;

a first weight configured to be selectively received within the first cavity; and a first slow loading mechanism coupled to the first tube proximate the second end and configured to slow the loading of the first weight into the first cavity, the first slow loading mechanism including a ring having a plurality of grip members.

14. The exercise device of claim 13, wherein the first tube is tapered between the first end and the second end such that an outer diameter of the first tube decreases from the first end to the second end.

15. The exercise device of claim 14, further comprising:

a second exercise bar comprising:

a second tube extending from a third end to a fourth end and defining a second cavity, the second tube configured to selectively couple to the first tube proximate the first and third ends;

a second weight configured to be selectively received within the second cavity; and a second slow loading mechanism coupled to the second tube proximate the fourth end and configured to slow the loading of the second weight into the second cavity.

16. The exercise device of claim 15, wherein the second tube is tapered between the third end and the fourth end such that an outer diameter of the second tube decreases from the third end to the fourth end.

17. The exercise device of claim 15, wherein the ring is a first ring and the plurality of grip members is a plurality of first grip members, and wherein the second slow loading mechanism includes a second ring having a plurality of second grip members.

18. The exercise device of claim 13, wherein the first slow loading mechanism comprises a grip surface.

19. The exercise device of claim 13, wherein the ring is first a flexible ring.

20. The exercise device of claim 19, wherein the flexible ring is configured to be replaced by a replacement flexible ring.

* * * * *